US011248421B2

(12) United States Patent
Saeterdal

(10) Patent No.: US 11,248,421 B2
(45) Date of Patent: Feb. 15, 2022

(54) OFFLOADING HYDROCARBONS FROM SUBSEA FIELDS

(71) Applicant: Subsea 7 Norway AS, Stavanger (NO)

(72) Inventor: Morten Saeterdal, Klepp St. (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/980,173

(22) PCT Filed: Mar. 13, 2019

(86) PCT No.: PCT/EP2019/056310
§ 371 (c)(1),
(2) Date: Sep. 11, 2020

(87) PCT Pub. No.: WO2019/175259
PCT Pub. Date: Sep. 19, 2019

(65) Prior Publication Data

US 2021/0002965 A1 Jan. 7, 2021

(30) Foreign Application Priority Data

Mar. 14, 2018 (GB) ..... 1804047

(51) Int. Cl.
*E21B 17/01* (2006.01)
*B63B 22/02* (2006.01)
(Continued)

(52) U.S. Cl.
CPC ..... *E21B 17/015* (2013.01); *B63B 22/023* (2013.01); *E21B 43/0107* (2013.01); *B63B 2035/448* (2013.01)

(58) Field of Classification Search
CPC ... E21B 17/015; E21B 43/0107; B63B 22/23; B63B 2035/448
(Continued)

(56) References Cited

U.S. PATENT DOCUMENTS 3,363,683 A * 1/1968 Corley, Jr. ..... E21B 43/0107 166/355
3,654,951 A 4/1972 Pogonowski et al.
(Continued)

FOREIGN PATENT DOCUMENTS

AU 2013248193 11/2013
GB 2 122 139 1/1984
(Continued)

*Primary Examiner* — Matthew R Buck
*Assistant Examiner* — Patrick F Lambe
(74) *Attorney, Agent, or Firm* — Levy & Grandinetti

(57) ABSTRACT

An offloading system for conveying hydrocarbons from a buoyancy-supported subsea riser to a surface tanker vessel comprises a flexible hose that hangs from the riser structure in a U-shape having first and second limbs. An upper end of the first limb communicates with the riser and an upper end of the second limb terminates in a pulling head for connecting the hose to the tanker. A clump weight acts on a lowermost bend of the hose between the limbs to maintain tension in the limbs. A subsurface holder fixed to the riser structure is arranged to hold the pulling head against the tension in the second limb of the hose when the system is in a standby state. The holder is offset laterally from a central longitudinal axis of the riser structure and a counterweight is positioned to a side of that axis opposed to the holder.

31 Claims, 7 Drawing Sheets

(51) Int. Cl.
*E21B 43/01* (2006.01)
*B63B 35/44* (2006.01)

(58) Field of Classification Search
USPC ..... 166/350
See application file for complete search history.

(56) References Cited

U.S. PATENT DOCUMENTS 3,955,599 A * 5/1976 Walker ..... B21D 7/10 138/103
4,194,568 A 3/1980 Buresi et al.
4,478,586 A 10/1984 Gentry et al.
4,556,343 A 12/1985 Cheung
4,643,614 A 2/1987 Laursen
4,647,255 A * 3/1987 Pow ..... B21D 9/03 405/168.1
5,275,510 A 1/1994 de Baan et al.
5,456,622 A 10/1995 Breivik et al.
6,382,320 B1 5/2002 Tilbrook et al.
6,412,433 B1 7/2002 Breivik et al.
6,517,291 B1 2/2003 Pollack
6,558,215 B1 5/2003 Boatman
6,564,873 B1 5/2003 Tilbrook et al.
6,688,348 B2 2/2004 Fontenot
6,817,809 B2 11/2004 Choi et al.
7,886,829 B2 2/2011 Edwards
8,292,546 B2 10/2012 Wu
8,734,055 B2 * 5/2014 Remery ..... E21B 43/01 405/171
8,944,871 B2 * 2/2015 Evensen ..... B63B 27/24 441/5
9,302,744 B2 * 4/2016 Pettersen ..... E21B 17/015
9,316,066 B2 4/2016 MacMillan et al.
2001/0017465 A1 8/2001 Errard
2004/0074649 A1 4/2004 Hatton et al.
2004/0077234 A1 4/2004 Lavagna et al.
2007/0048093 A1 3/2007 Bhat et al.
2008/0007056 A1 * 1/2008 Beesley ..... E21B 43/0107 285/321
2011/0226484 A1 9/2011 Lavagna
2012/0225597 A1 9/2012 Straume et al.
2013/0022406 A1 1/2013 Roveri et al.
2013/0263426 A1 10/2013 Luppi
2014/0041878 A1 * 2/2014 Hatton ..... E21B 17/085 166/350
2015/0047852 A1 * 2/2015 Pionetti ..... E21B 17/012 166/350
2015/0101819 A1 4/2015 Legras
2017/0122079 A1 * 5/2017 Kristoffersen ..... E21B 43/0107

FOREIGN PATENT DOCUMENTS

GB 2473018 3/2011
WO WO 85/03494 8/1985
WO WO 93/11030 6/1993
WO WO 98/14363 4/1998
WO WO 99/00579 1/1999
WO WO 99/42358 8/1999
WO WO 99/50527 10/1999
WO WO 02/076816 10/2002
WO WO 2006/090102 8/2006
WO WO 2009/117901 10/2009
WO WO 2011/096819 8/2011
WO WO 2012/051148 4/2012
WO WO 2013/037002 3/2013
WO WO 2015/022477 2/2015

* cited by examiner

OFFLOADING HYDROCARBONS FROM SUBSEA FIELDS

This invention relates to offshore offloading solutions for exporting hydrocarbon fluids, such as oil produced from subsea wells. The invention is particularly concerned with the challenges of connecting an oil tanker temporarily to an installation on the seabed, especially in deep water.

Offshore exploration for oil and gas is being performed in ever more challenging waters, with fields now being developed in water depths of 3000 m or more. To recover hydrocarbons from such depths, designers of riser and offloading systems face difficult technical challenges. Those challenges may be compounded by the characteristics of deep sea hydrodynamics and by low reservoir temperatures.

The invention also arises from the challenges of developing marginal subsea oil fields, including small, remote or inaccessible fields. Addressing those challenges requires the cost of production and of capital investment to be minimised.

A typical subsea oil production system comprises production wells each with a wellhead, pipelines running on the seabed, structures to support valves and connectors, manifolds and risers to bring production fluids to the surface. At the surface, a topside installation that can be a platform or a vessel receives the production fluids before their onward transportation.

Crude oil is a multiphase fluid that generally contains sand, oil, water and gas. These components of the wellstream interact in various ways that tend to decrease the flow rate in the production system, from the wellhead to storage. A critical failure mode in crude oil production is clogging or plugging of pipelines by solids because remediation of such blockages can be extremely expensive, especially in deep water.

When the temperature of a wellstream decreases below a certain threshold, at a given pressure, components of crude oil may react together or individually to coagulate or precipitate as solid wax, asphaltenes or hydrates that could plug a pipeline. For example, wax will typically appear in oil at a temperature of around 30° C.

As crude oil is hot at the outlet of a wellhead, typically around 200° C., one approach in subsea oil production is to maintain the oil temperature above the critical threshold until the oil has been delivered to a topside installation. There, the oil can be treated to allow the treated oil to be transported at ambient temperature in tankers or in pipelines.

Two main approaches are known in the art to reduce the cost of producing oil from subsea fields, especially marginal subsea fields. A first approach is to simplify subsea equipment as much as possible, for example by using a long, insulated and optionally also heated pipeline extending from a wellhead and minimal additional equipment subsea. Where fields are isolated or remote, a challenge of that approach is that the cost of installing and optionally heating a long pipeline becomes a large element of the cost of development and operation.

Marginal fields require low-cost solutions. In many cases, particularly for isolated fields, it is important to remove the pipeline cost. One alternative is to use a subsea storage unit to store produced crude oil before offloading. For example, crude oil may be stored in an inflatable bag on the seabed.

Thus, the present invention arises from—but is not limited to—a second approach, namely to transfer at least some conventionally-topside production and storage functions to a subsea location for intermittent export of oil by shuttle tanker vessels. This involves subsea separation, processing and storage of produced oil. By displacing at least some oil processing steps from the topside to the seabed, the need for thermal insulation or heating can be reduced.

It follows that there is a need periodically to export or offload oil that has been processed and stored subsea whenever transfer to a tanker vessel is required. For offloading, a shuttle tanker connects either directly to a storage unit or indirectly to a distinct export system that typically comprises a buoy.

Many solutions are known for offshore offloading of hydrocarbon fluids. Most involve exporting such fluids from a surface or topside storage facility to a tanker that is fluidly connected to the topside storage facility. Usually, hose storage systems are located on the topside storage facility. For example, in WO 99/42358 the topside storage facility is a floating storage and offloading (FSO) vessel and in WO 2015/22477, the topside storage facility is a buoyant SPAR platform. WO 99/00579 and WO 98/14363 also disclose SPAR platforms, which in these examples are connected to a subsea storage facility.

Topside storage facilities such as FSOs and SPARs are complex and bulky structures that are very costly. Additionally, connecting them to a tanker can be challenging.

A tanker may connect to an offloading buoy, also located at the surface. The offloading buoy is fluidly connected to a line at or near to the surface known as an offloading line (OLL) that is picked up by the tanker and hauled aboard for connection. This does not remove the need for surface systems.

Sometimes, partial storage is provided by a surface buoy as disclosed in WO 2009/117901. U.S. Pat. Nos. 6,688,348 and 5,275,510 disclose another export system in which a near-surface termination buoy supports an export hose. Specifically, in U.S. Pat. No. 5,275,510 a series of hoses are connected to a subsea manifold buoy, itself connected to a surface buoy that is picked up and connected to a shuttle tanker.

Permanent risers are known, for example as disclosed in WO 2013/037002, connected by flexible jumper pipes to a floating production storage and offloading (FPSO) vessel or other surface facility. A drawback of this arrangement is its permanence: an FPSO must be on station continuously to process hydrocarbons flowing from the riser; similarly, the jumper pipes between the riser and the FPSO are a permanent system that will typically remain in place until the riser is decommissioned. An additional export system from the FPSO to a shuttle tanker remains necessary, either directly or via a buoy as described above.

WO 2006/090102 discloses a tank system anchored to the seabed.

US2011/226484 describes a steel catenary riser. The riser is connected to a sub-surface buoy by a riser collar that engages a flexible element. The tensile loads in the riser are transferred to compressive loads in the flexible element, which is beneficial when the riser moves relative to the sub-surface buoy.

US 2004/077234 describes a hydrocarbon transfer system where an FPSO is connected to an off-loading buoy. The motions of the FPSO and buoy are de-coupled from the pipeline that connects them.

Furthermore, various subsea riser structures are outlined in US 2013/022406, GB 2473018, AU 2013248193, U.S. Pat. No. 4,643,614, US 2015/101819, US 2004/074649, U.S. Pat. No. 4,194,568, WO 2012/051148 and US 2011/017465.

In WO 85/03494 a visiting tanker connects directly to a subsea storage tank. In U.S. Pat. No. 3,654,951, an export hose is folded onto a subsea storage tank. This is not realistic for deep-water systems because the hose would be impractically long and would be likely to be crushed by hydrostatic pressure.

US 2013/263426 describes a method for installing an offshore installation for capturing crude oil that is escaping from a damaged well. The method includes lowering a rigid canopy over the damaged well to prevent crude oil leaking into the sea. Crude oil may then be offloaded to a tanker on the surface via a flexible pipe.

WO 99/50527 describes a structure for imparting tension on a subsea riser.

WO 02/076816 discloses a subsea storage tank and an export riser that is a free-standing vertical column tensioned by a subsea buoy. The subsea buoy retains a flexible export hose that floats between the subsurface buoy and a surface buoy. A mooring line is accessible near the surface from a shuttle tanker. The surface buoy is recovered by the tanker and used to connect the hose. This arrangement places permanent lines and other equipment within the splash zone, just below the surface, where sea dynamics are influential. There is therefore a risk of generating fatigue in hoses, lines and other equipment. There is also a risk of clashing with vessels at the surface.

Thus, a drawback of many of the above prior art solutions is the requirement for expensive development that makes exploitation of small, remote fields uneconomical. Another drawback is the presence of permanent equipment at or just below the sea surface, generating a risk of clashing with vessels and fatigue caused by sea motion. Also, many of the above prior art solutions rely on surface units, which makes them unsuitable for use in deep water.

U.S. Pat. No. 9,302,744 discloses offshore offloading from a seabed installation where a head of a flexible offloading riser is supported in mid-water on an anchored sub-surface buoy. The flexible riser is in a wave configuration with slack sections so that it can flex and slide through the buoy when the head is pulled to the surface by shuttle tanker. This solution has the major drawback of substantial horizontal offset between the foot or base of the riser and the buoy. Consequently, the buoy is susceptible to lateral displacement throughout the operational life of the system, hence generating fatigue in the riser.

WO 93/11030 shows another type of offloading subsurface buoy. The head of a riser is pulled into a receptacle of a shuttle tanker for offloading operations. The buoy is moored by catenary mooring lines and a vertical tendon, which reduces lateral movement but also reduces vertical movement. Mooring lines are a drawback in congested areas with subsea pipelines and equipment.

FIGS. 1*a*, 1*b* and 1*c* of the accompanying drawings show another existing offloading system. Here, a shuttle tanker 10 is shown floating on the surface 12 beside a pick-up zone 14 above a riser column 16. The riser column 16 extends upwardly from the seabed 18 to a sub-surface buoy 20. A weighted line 22 hangs back down from the buoy 20 toward the seabed 18 and terminates in a messenger line 24 that extends upwardly from the end of the weighted line 22 to the surface 12.

When the tanker 10 arrives at the offloading location as shown in FIG. 1*a*, the tanker 10 locates, picks up and pulls up the messenger line 24 and the weighted line 22 as shown in FIG. 1*b*. The tanker 10 then moves to the loading position with its bow on the radius of the pick-up zone 14 as shown in FIG. 1*c*, where the tanker 10 is coupled to the riser column 16 via the weighted line 22 for offloading hydrocarbon fluid such as crude oil.

The considerable lengths of the weighted line 22 and the messenger line 24 are costly and challenging to handle, especially as water depth increases.

Against this background, the invention may be expressed as a subsea riser structure for offloading hydrocarbons, the structure comprising: a riser column; a sub-surface buoy that supports the riser column; and an offloading system for conveying hydrocarbons from the riser column to a surface tanker vessel. The offloading system comprises: a flexible hose hanging from the riser structure in a U-shape having first and second limbs, an upper end of the first limb fluidly communicating with the riser column and an upper end of the second limb terminating in a pulling head for connecting the hose to the tanker; at least one clump weight acting on a lowermost bend of the hose between the first and second limbs to maintain tension in the first and second limbs; and a sub-surface holder fixed to the riser structure, the holder being arranged to hold the pulling head against said tension in the second limb of the hose when the system is in a standby state.

The holder may be offset laterally from a central longitudinal axis of the riser column, for example by being cantilevered away from a side of the riser structure. In that case, the riser structure may further comprise at least one counterweight that is positioned to a side of the central longitudinal axis opposed to the holder.

Conveniently, the holder may be arranged also to guide the second limb of the hose when the pulling head is disengaged from the holder. For example, the holder may surround the second limb of the hose when the pulling head is disengaged from the holder.

Advantageously, the first and second limbs of the hose may lie in a substantially vertical plane and preferably are substantially parallel to each other. Moreover, the limbs of the hose are preferably substantially parallel to the riser column and both limbs may be substantially coplanar with the riser column.

The hose may be movable along its length relative to the or each clump weight. For example, the or each clump weight may be supported by a cradle that embraces the lowermost bend of the hose, the cradle defining a path along which the hose may move relative to the cradle. For this purpose, the or each clump weight may be hung from the hose via one or more rollers that lie on the lowermost bend of the hose.

Conveniently, the or each clump weight may act on the hose via a bend restrictor that limits the bend radius of the lowermost bend of the hose. The bend restrictor may have a limiting radius defined by an array of rollers on an upper side of the lowermost bend of the hose. Those rollers may also allow the hose to move along its length relative to the or each clump weight.

The pulling head may comprise a downwardly-tapering engagement formation that complements a downwardly-narrowing engagement formation of the holder. Elegantly, the downwardly-tapering engagement formation of the pulling head may be a bend stiffener that surrounds the hose.

Preferably, the pulling head comprises at least one buoyancy element that confers positive buoyancy on the pulling head. However, negative buoyancy of the second limb of the hose and of the or each clump weight acting on the pulling head may exceed the positive buoyancy of the pulling head.

Preferably the sub-surface buoy holds the riser column upright and under tension. The riser column may be a rigid or flexible riser. The holder is suitably attached to the buoy of the riser structure and may be disposed at a level above or below a centre of buoyancy of the buoy.

The inventive concept embraces a corresponding method of offloading hydrocarbons to a surface tanker vessel from a buoyantly-supported subsea riser structure. That method comprises: imparting tension in first and second limbs of a flexible hose that hangs from the riser structure in a U-shape, an upper end of the first limb fluidly communicating with a riser column of the riser structure and an upper end of the second limb terminating in a pulling head for connecting the hose to the tanker; and holding the pulling head against said tension in the second limb of the hose, when the pulling head is sub-surface in a standby state.

The pulling head may be held at a position offset laterally from a central longitudinal axis of the riser structure. In that case, a counterbalancing moment may be applied to the riser structure to a side of the central longitudinal axis opposed to the pulling head.

Upward movement of the second limb of the hose against said tension may be guided relative to the riser structure when the pulling head is being lifted toward the tanker.

Tension is imparted in the limbs of the hose by hanging at least one clump weight from a lowermost bend of the U-shape. The hose may be moved along its length relative to the or each clump weight. Preferably, a bend radius of the hose at a lowermost bend of the U-shape is limited by a bend restrictor, which may support the or each clump weight.

Buoyant upthrust of the pulling head may be exceeded by the tension in the second limb of the hose.

When engaging the pulling head with a holder fixed relative to the riser, that engagement may conveniently be promoted by the tension in the second limb of the hose.

When lifting the pulling head toward the tanker. the first limb of the hose may shorten and the second limb of the hose may lengthen. Similarly, a U-shaped portion of the hose hanging from the riser structure may shorten when lifting the pulling head toward the tanker. Nevertheless, a U-shaped portion of the hose is preferably left hanging from the riser structure when the pulling head has been connected to the tanker. This allows for movement of the tanker relative to the riser structure and, in conjunction with a clump weight, may help to damp movements of the hose driven by such movement of the tanker.

The invention minimises the cost of equipment and shuttle tanker operation time when offloading hydrocarbons from a subsea field. The system of the invention enables a shuttle tanker to load crude oil or other hydrocarbons safely and efficiently from an offshore offloading riser, a rigid pipe with a buoy, a flexible riser with a buoy or other subsea storage facility or source.

An offloading riser is not necessarily structurally different to a production riser. However, unlike a production riser, an offloading riser does not permanently contain flowing fluid. This is because an offloading riser transfers a fluid from a seabed production and storage system to the surface only when it is connected to a shuttle tanker.

Embodiments of the invention provide a hose handling system for offloading crude oil to a shuttle tanker, the system comprising a hose for transporting oil between an export buoy and a shuttle tanker; wherein the hose comprises a pulling and connection head, a fluid interface with the export buoy and a clump weight at its lowest point; and a balance and guide device comprising a cantilever arm with a counterweight mounted on the export buoy and a guide and docking mechanism. The hose can move between a first configuration in which its head is docked to the balance and guide device, and a second configuration in which its head is connected to a shuttle tanker.

The pulling and connection head of the hose may be substantially buoyant to compensate for the weight of the hose in water.

The head may comprise a connector hub, a bend stiffener and a connection to a surface buoy through a line for retrieval and pulling.

Conveniently, the clump weight may remain at the lowest point of the hose by virtue of gravity. Thus, the clump weight may be displaceable along the hose, for example by sliding or by rolling. For example, the clump weight may be mounted on the hose by a U-shape bend restrictor fitted with rollers.

The balance and guide device preferably keeps the hose in a substantially vertical plane.

The hose preferably adopts a U-shape between its connection to the export buoy and the guide and docking mechanism due to gravity, in order to minimise loads that could fatigue the hose.

Preferably the pulling and connection head of the hose is substantially vertically aligned with the guide of the guide and docking mechanism.

The guide and docking mechanism may comprise a sleeve with funnelled openings and an inner coating or inner rounded shape to ease sliding, and a clamping unit comprising fingers or other clamping elements that can engage the pulling and connection head of the hose.

In summary, the invention provides an offloading system for conveying hydrocarbons from a buoyancy-supported subsea riser to a surface tanker vessel. The system comprises a flexible hose hanging from the riser structure in a U-shape having first and second limbs. An upper end of the first limb communicates with the riser and an upper end of the second limb terminates in a pulling head for connecting the hose to the tanker. A clump weight acts on a lowermost bend of the hose between the limbs to maintain tension in the limbs.

A sub-surface holder fixed to the riser structure is arranged to hold the pulling head against the tension in the second limb of the hose when the system is in a standby state. Where the holder is offset laterally from a central longitudinal axis of the riser structure, a counterweight is positioned to a side of that axis opposed to the holder.

To illustrate the prior art background, reference has already been made to FIGS. 1*a*, 1*b* and 1*c* of the accompanying drawings. Those drawings are a sequence of schematic perspective views showing the operation of an existing offloading system.

In order that the invention may be more readily understood, reference will now be made, by way of example, to the remainder of the accompanying drawings, in which like numerals are used for like features. In those drawings:

FIG. 1*a* shows an offloading system of the prior art.

FIG. 1*b* shows another offloading system of the prior art.

FIG. 1*c* shows yet another offloading system of the prior art.

Figure 2:
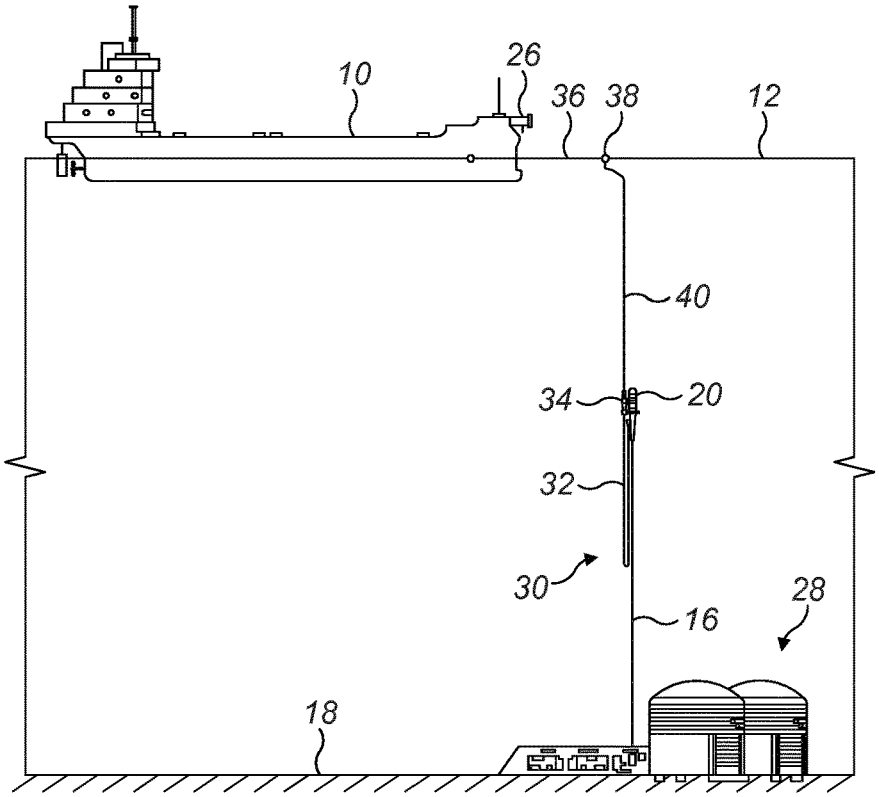
FIG. 2 is a side view of a shuttle tanker using an offloading system of the invention to offload oil processed and stored on the seabed in a subsea processing and storage installation.
Figure 3:
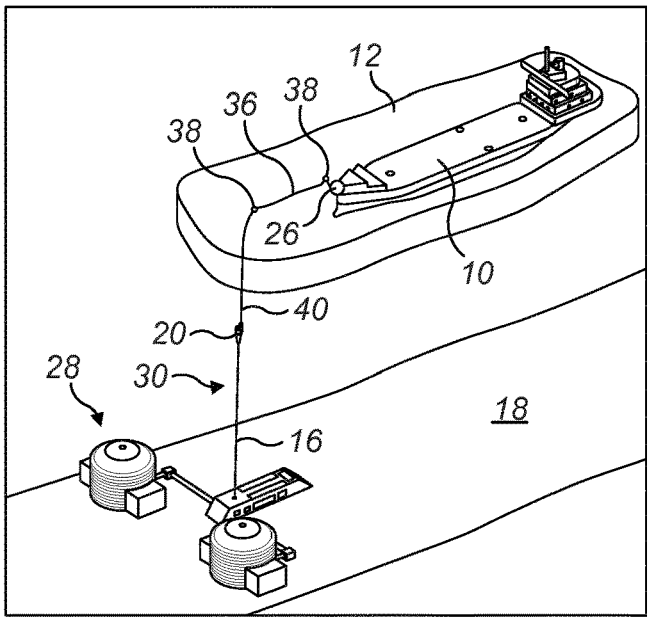
FIG. 3 is a perspective view of the tanker, offloading system and subsea processing and storage installation shown in FIG. 2.

Referring to FIGS. 2 and 3, which are not to scale, a shuttle tanker 10 equipped with a conventional bow loading system 26 is shown floating on the surface 12 above a riser column 16.

The riser column 16 extends upwardly from the seabed 18 to a sub-surface buoy 20. The riser column 16 exemplified here comprises a flexible pipe that is kept upright and under tension by the buoy 20. In this example, the buoy 20 is at a depth of approximately 75 m below the surface 12. The depth from the surface 12 to the seabed 18 can be very much greater, in principle ranging from about 150 m to more than 3 km. Consequently, the riser column 16 may be extremely long but it is protected from damaging water dynamics near the surface 12.

The riser column 16 may alternatively be made as a string of metallic rigid pipes or as a pipeline in composite materials.

In this example, the riser column 16 is arranged to offload oil that is processed and stored on the seabed 18 in a subsea processing and storage installation 28. The benefits of the invention make it particularly apt for use when exploiting marginal fields for which a subsea processing and storage installation 28 may be helpful, including small, remote or inaccessible fields. However, the invention is not limited to such use and may find application with any subsea riser that terminates in a sub-surface support, especially where that riser is in deep water.

The riser column 16 is adapted by the addition of an offloading system 30 in accordance with the invention, whose main components will now be described.

The offloading system 30 comprises a loading riser hose 32 that hangs in parallel beside the riser column 16 in a U-shape below, and extending back up to, the buoy 20. Specifically, a first limb of the U-shaped hose 32 communicates with the riser column 16 at the buoy 20 and hangs from the buoy 20. A second parallel limb of the U-shaped hose 32 terminates at its free end in, and hangs from, a head 34 that is supported by the buoy 20.

Typically the hose 32 is of bonded or unbonded flexible pipe. Bonded or unbonded flexible pipe has a multi-layered pipeline structure comprising elements that allow the pipe to be bent with a small radius of curvature without damage.

Figure 4:
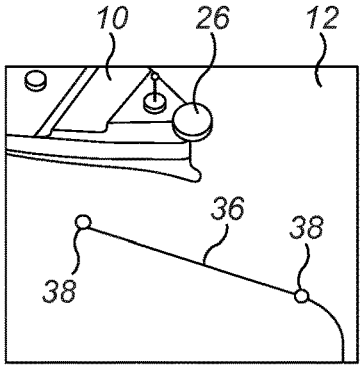
FIG. 4 is an enlarged detail perspective view showing a floating line with pick-up buoys on the surface beside the tanker.

FIGS. 2 to 4 show the tanker 10 picking up a floating line 36 at the surface 12. Conventionally, the tanker 10 may be guided to that location by a transponder system. The floating line 36 is supported at the surface 12 by a pair of pick-up buoys 38, as best shown in the enlarged view of FIG. 4.

FIGS. 2 and 3 show that the floating line 36 is joined to a messenger line 40 that extends down below the surface 12 to the head 34 of the hose 32 supported by the buoy 20. Thus, when a winch on the tanker 10 picks up and pulls on the floating line 36, the messenger line 40, in turn, pulls on the head 34 and on the limb of the U-shaped hose 32 that hangs from the head 34. The U-shaped portion of the hose 32 shortens accordingly as the limb of the hose 32 hanging from the head 34 is pulled up past the buoy 20, which causes the limbs of the hose 32 progressively to become more unequal in length.

The head 34 is thereby pulled to the surface 12 to couple the hose 32 and hence the riser column 16 to the tanker 10 via a manifold valve in the bow loading system 26 of the tanker 10. In the bow loading system 26, a ball joint in a loading manifold provides a substantially moment-free connection between the hose 32 and the tanker 10.

Figure 1A:
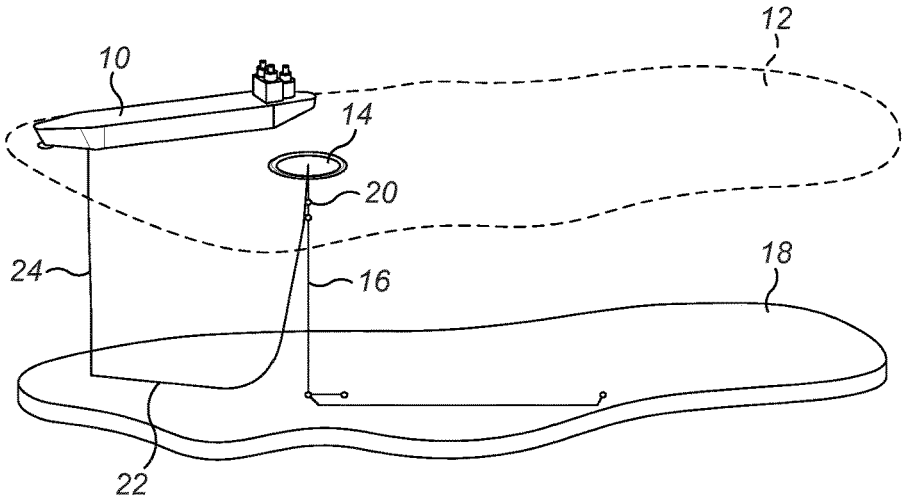
FIG. 1a Prior Art
Figure 1B:
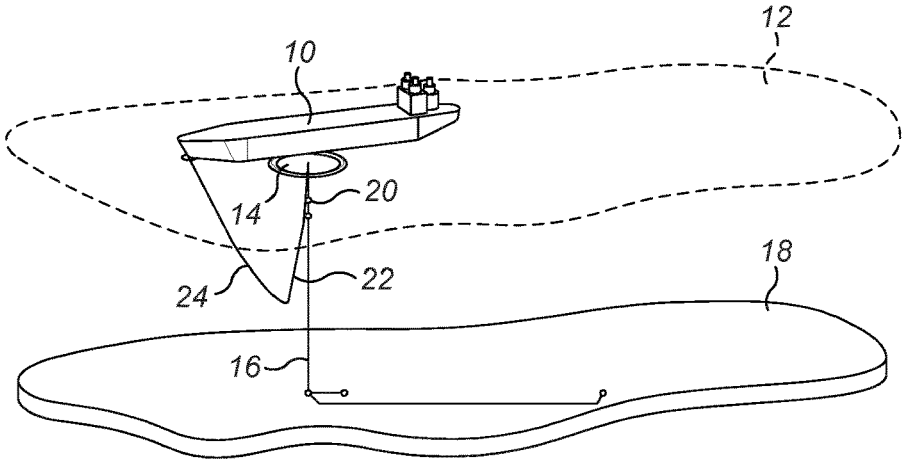
FIG. 1b Prior Art
Figure 1C:
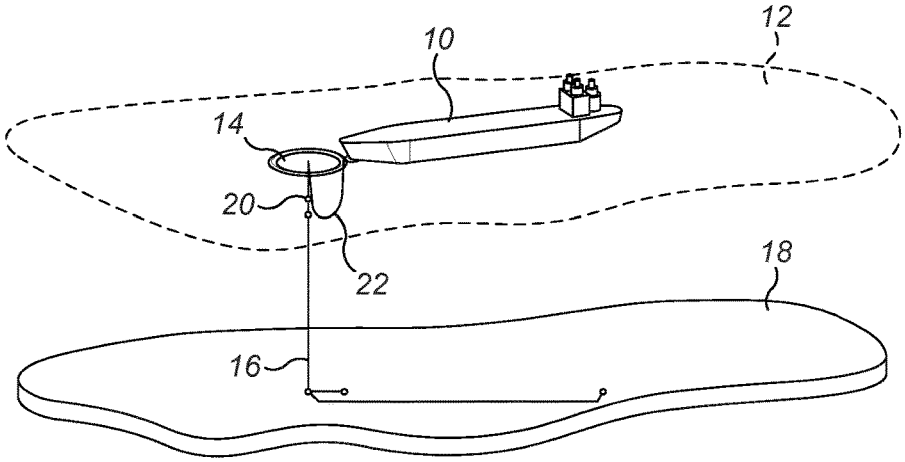
FIG. 1c Prior Art

It will be apparent that the design of the offloading system 30 greatly simplifies the pickup system comprising the messenger line 40 and makes it independent of the water depth. In particular, the messenger line 40 is very much shorter than the messenger line 24 shown in the prior art arrangement of FIGS. 1*a* to 1*c*. This is because the messenger line 40 need only reach from the buoy 20 to the floating line 34 at the surface 12. Thus, the messenger line 40 is less expensive and is easier to handle, and the tanker 10 requires less time to perform connection and disconnection operations. A further significant cost saving is achieved by eliminating the weighted line 22 of the prior art arrangement.

Figure 5:
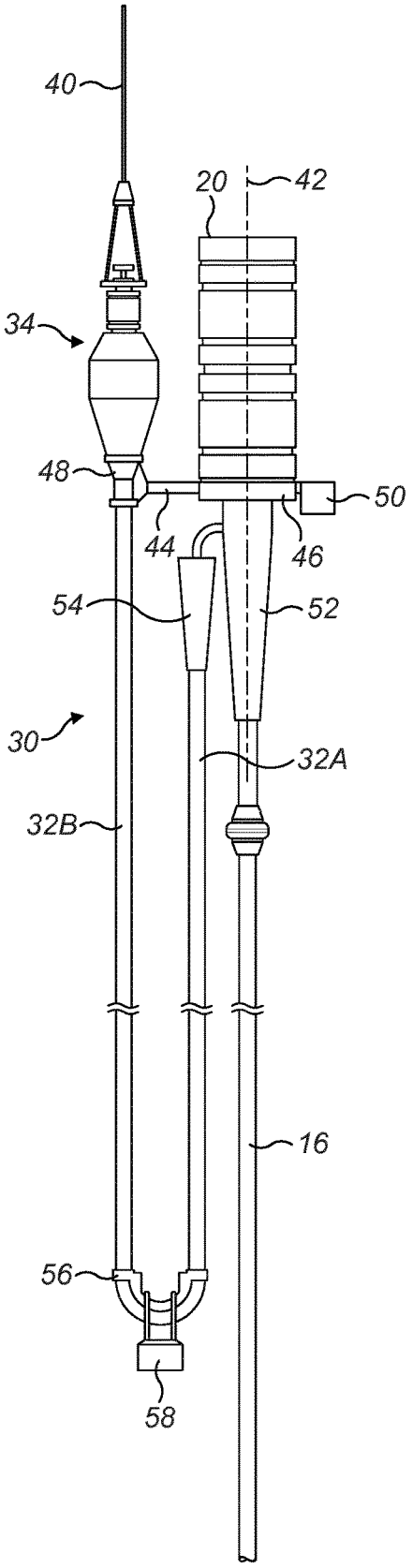
FIG. 5 is a side view of the offloading system of the invention, in a standby state not yet connected to the tanker.
Figure 6:
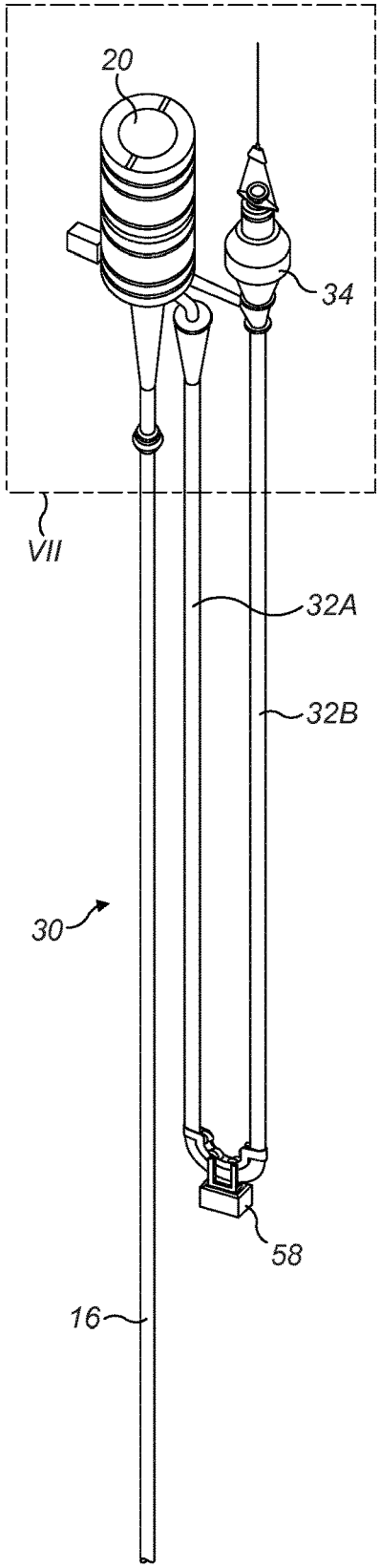
FIG. 6 is a perspective view of the offloading system as shown in FIG. 5.
Figure 7:
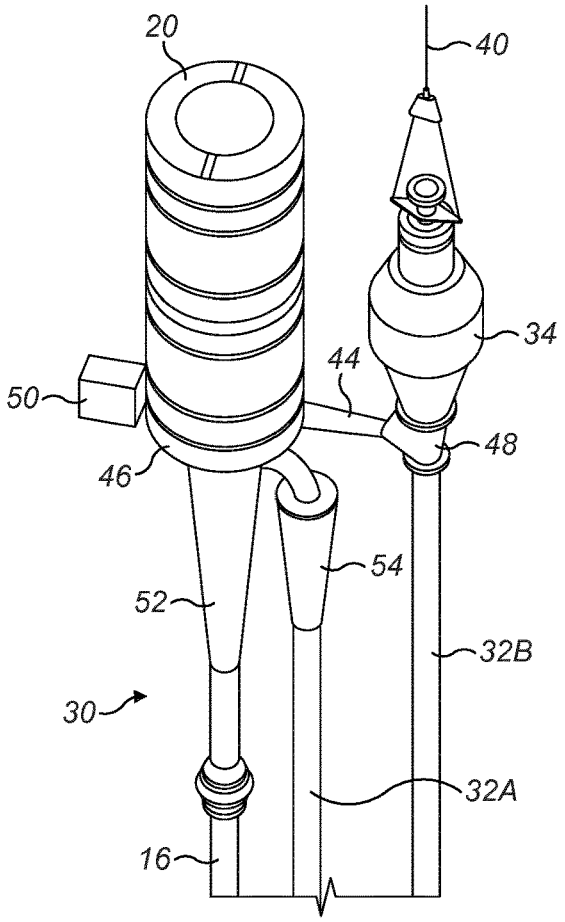
FIG. 7 is an enlarged perspective view corresponding to Detail VII of FIG. 6.

Features of the riser column 16 and the offloading system 30 are shown in more detail in FIGS. 5 to 7 of the drawings, to which the following description refers.

The sub-surface buoy 20 has a cylindrical buoyant body that may comprise one or more hollow chambers, may be formed of rigid buoyant material such as syntactic foam or may contain a mass of rigid buoyant macrospheres, depending upon the hydrostatic pressure expected at the operational depth.

The buoy 20 and the riser column 16 are aligned with each other on a common central longitudinal axis 42.

A guide and docking stab 44 extends laterally to one side of the buoy 20 from a structure 46 fixed at the lower end of the buoy 20. The stab 44 comprises a frusto-conical collar 48 that is cantilevered from the structure 46 and that is centred on an axis extending substantially parallel to the central longitudinal axis 42 of the riser column 16. The collar 48 is adapted to receive, support and locate the head 34 of the hose 32, in the manner of a socket receiving a plug.

A counterweight 50 is also attached to the structure 46 at the lower end of the buoy 20, being cantilevered from a side of that structure 46 opposed to the guide and docking stab 44 about the central longitudinal axis 42. The counterweight 50 provides a counterbalancing effect for the offloading system 30, as will be explained.

A downwardly-tapering bend stiffener 52 that surrounds the upper section of the riser column 16 is also fixed to the structure 46 at the lower end of the buoy 20.

The hose 32 connects to the upper section of the riser column 16 immediately beneath the buoy 20. The hose 32 in connected to the riser column 16 to the same side of the central longitudinal axis 42 as the guide and docking stab 44 that extends from the structure 46 of the buoy 20 above. Viewed from above, the hose 32 is in co-planar angular alignment with the guide and docking stab 44.

In this example, the hose 32 is connected to the riser column 16 through the side of a bend stiffener 52. The hose 32 hangs downwardly from that connection to extend parallel to the riser column 16 as the first limb 32A of the U-shape. The hose 32 is also fitted with a bend stiffener 54 around its end connected to the riser column 16.

At the bottom of the U-shape, the hose 32 bends through 180° around a bend restrictor 56 and then extends upwardly into the second limb 32B of the U-shape. A clump weight 58 is attached to the bend restrictor 56 to maintain tension in both limbs 32A, 32B of the U-shaped hose 32.

The second limb 32B extends substantially parallel to the first limb 32A and to the riser column 16 and terminates at its upper end in the head 34, which is shown in FIGS. 5 to 7 engaged with the collar 48 of the guide and docking stab 44.

The lateral spacing between the first and second limbs 32A, 32B of the hose 32 is determined by the properties of the hose 32, in particular its Minimum Bend Radius or MBR. For example, an MBR of two metres may be appropriate for a flexible hose 32 having an internal diameter of twenty inches (50.8 cm).

Figure 8:
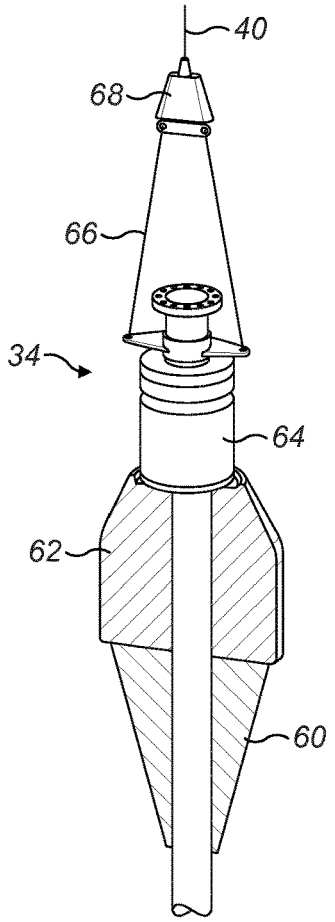
FIG. 8 is an enlarged part-sectioned perspective view of a hose head of the system as shown in FIGS. 5 to 7.

The features of the head 34 are shown in detail in FIG. 8 of the drawings. From bottom to top, the head 34 comprises:

a frusto-conical bend stiffener 60 around the free end of the hose 32 that, in addition to protecting the hose 32, complements and engages in the frusto-conical collar 48 of the guide and docking stab 44;

- a buoyancy element 62 that partially offsets the weight in water of the head 34 and the proportion of the weight in water of the hose 32, the bend restrictor 56 and the clump weight 58 that is carried by the head 34;
- a hose end valve 64 that is cooperable with a manifold valve in the bow loading system 26 of the tanker 10;
- permanent rigging 66 that connects the head 34 to the messenger line 40; and
- a buoyancy element 68 that confers positive buoyancy on the permanent rigging 62 to hold the permanent rigging 62 above the head 34.

The buoyancy elements 62, 68 are conveniently of syntactic foam but may instead comprise hollow chambers or contain a mass of rigid buoyant macrospheres.

It will be apparent that the aggregate weight load of the hose 32, the bend restrictor 56 and the clump weight 58 is shared between the riser column 16 acting against tension in the first limb 32A of the hose 32 and the head 34 acting against tension in the second limb 32B of the hose 32.

Together, the buoyancy elements 62, 68 confer positive buoyancy on the head 34. However, the resulting buoyant upthrust acting on the head 34 is slightly less than half of the aggregate weight in water of the hose 32, the bend restrictor 56 and the clump weight 58. Hence, the weight load carried by the head 34 is sufficient to overcome the positive buoyancy of the head 34. This makes the combination of the head 34 and of the components 30, 56, 58 suspended from the head 34 slightly negatively buoyant.

Nevertheless, by reducing the apparent aggregate weight of the head 34 and of the components 30, 56, 58 suspended from the head 34, the buoyancy of the buoyancy elements 62, 68 reduces the pivoting moment that acts on the buoy 20 about a horizontal axis when the head 34 is engaged with the collar 48 of the guide and docking stab 44.

The counterweight 50 that is opposed to the collar 48 of the guide and docking stab 44 about the central longitudinal axis 42 provides a counterbalancing moment. That counterbalancing moment substantially balances the moment exerted on the riser column 16 through the first limb 32A of the hose and the remaining moment exerted on the buoy 20 by the head 34 engaged with the collar 48. Thus, the net pivoting moment exerted on the riser column 16 and the buoy 20 by the offloading system 30 is negligible.

If the MBR of the hose 32 requires the lateral spacing between the first and second limbs 32A, 32B to be increased, this requires the collar 48 of the guide and docking stab 44 to be spaced further from the central longitudinal axis 42. In that case, the mass of the counterweight 50 and/or its lateral offset from the central longitudinal axis 42 should also be increased.

When the head 34 is disengaged from the collar 48 of the guide and docking stab 44, the buoyancy of the buoyancy elements 62, 68 also reduces the pull-in force that has to be exerted on the messenger line 40 by a winch on the tanker 10. This makes it easier and quicker to raise the head 34 to the surface 12.

Figure 9:
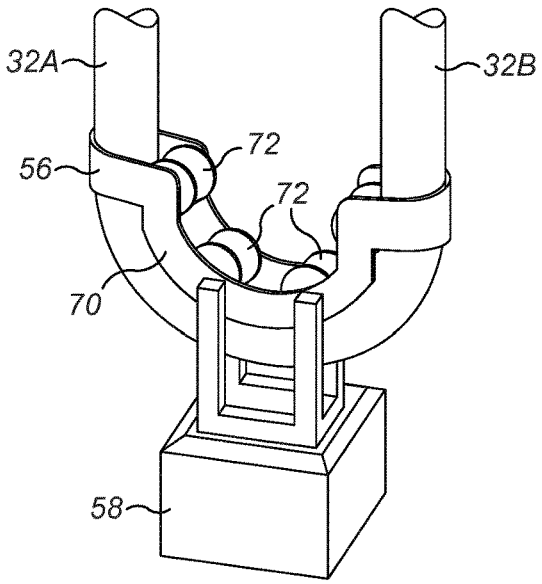
FIG. 9 is an enlarged perspective view of a bend restrictor and clump weight of the system as shown in FIGS. 5 and 6.

The features of the bend restrictor 56 and the clump weight 58 are shown in detail in FIG. 9 of the drawings. Here, it can be seen that the bend restrictor 56 comprises a U-shaped cradle 70 that embraces the 180° bend at the bottom of the U-shaped hose 32. The clump weight 58 hangs from the cradle 66 beneath the hose 32 on the outer side of the 180° bend.

The cradle 70 supports a U-shaped array of rollers 72 that rest on top of the hose 32 on the inner side of the 180° bend. The rollers 72 have respective axes of rotation that are parallel to each other and to the axis of curvature of the 180° bend. The relative positions of the rollers 72 limits bending of the hose 32 and so determines the MBR at the 180° bend. This protects the hose 32 from permanent damage due to overbending.

Figure 10:
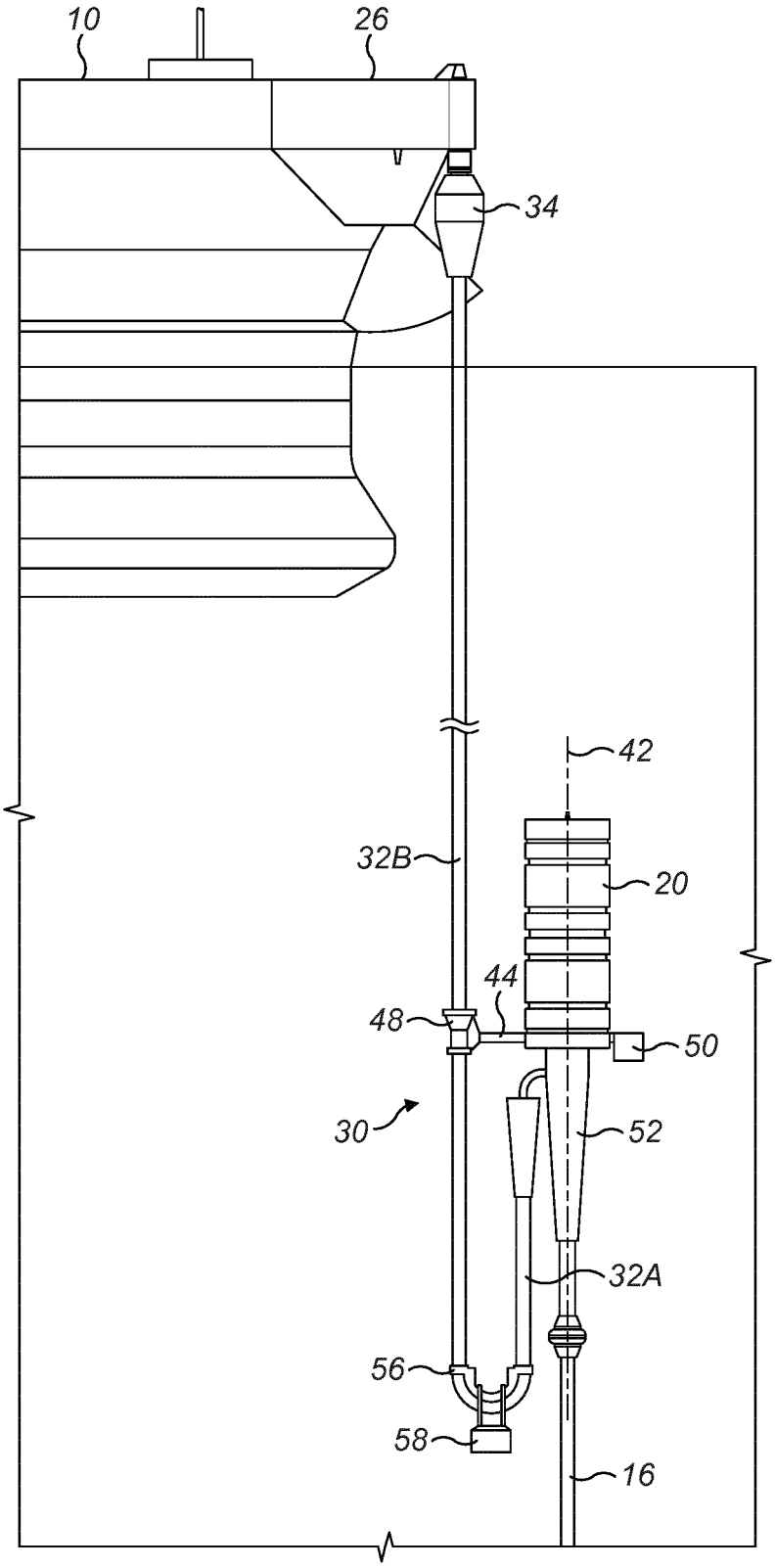
FIG. 10 is a side view of the offloading system of the invention, in an operational state when connected to the tanker.
Figure 11:
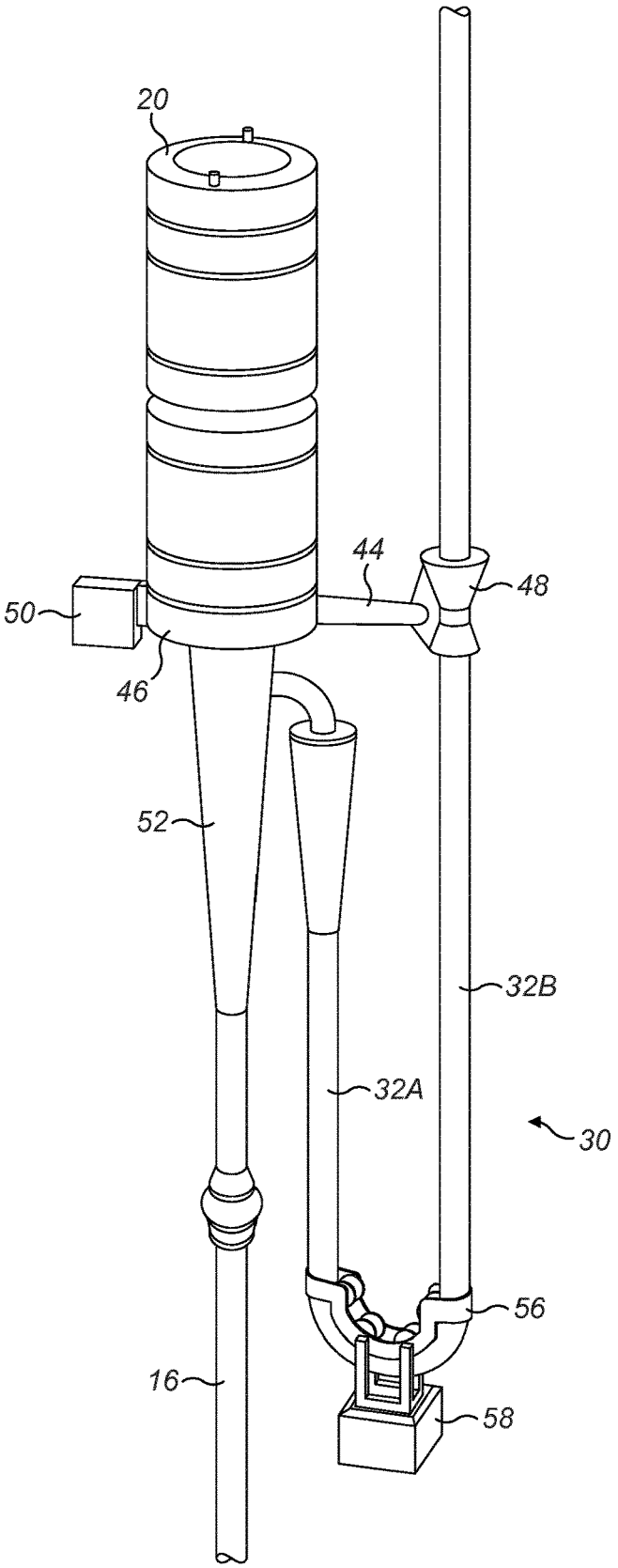
FIG. 11 is a perspective view of the offloading system as shown in FIG. 10.

Turning next to FIGS. 10 and 11, these drawings show the offloading system 30 in an operational state with the head 34 of the hose 32 connected to the bow loading system 26 of the tanker 10.

As the head 34 is lifted on the messenger line 40 toward the tanker 10, the second limb 32B of the hose 32 slides up through the collar 48 as the U-shaped portion of the hose 32 beneath the guide and docking stab 44 shortens accordingly. Thus, the bend restrictor 56 and the clump weight 58 are lifted toward the buoy 20 while remaining at the lowest point of the U-shaped portion of the hose 32. It will therefore be apparent that the hose 32 moves through the bend restrictor 56 as the rollers 72 turn about their respective axes of rotation. During that relative movement, the bend restrictor 56 continues to control the bend radius of the 180° bend in the hose 32.

As the upthrust of its buoyancy is lost when the head 34 of the hose 32 clears the surface 12, the winch on the tanker 10 must briefly exert an increased pull-in force at that stage. The increased pull-in force then comprises the weight in air of the head 34, the weight in water of the second limb of the hose 32B and half of the weight in water of the bend restrictor 56 and the clump weight 58.

When the head 34 of the hose 32 has been connected to the bow loading system 26 of the tanker 10, a remaining U-shaped portion of the hose 32 extends a few metres, for example eight metres, beneath the guide and docking stab 44. This slack portion of the hose 32 compensates for movements of the tanker 10 relative to the buoy 20 during offloading, such as surge and sway, and functions as a sprung damper with the aid of the ballast provided by the bend restrictor 56 and the clump weight 58.

The skilled reader will appreciate that the hose 32 should not be exposed to contact with sharp edges or snagging points. In this respect, the lateral offset of the collar 46 of the guide and docking stab 44 and its vertical spacing from the top of the buoy 20 ensure that the tanker 10 can rotate 360° within a pick-up zone above the riser column 16 during offloading. The lateral offset of the collar 46 and the weight of the bend restrictor 56 and the clump weight 58 also minimise any risk of clashing between the U-shaped portion of the hose 32 and the parallel riser column 16.

While the head 34 remains disengaged from the collar 48, the guide and docking stab 44 will no longer carry the apparent weight of the head 34 and of the components suspended from the head 34. Thus, the moment that continues to be exerted on the structure 46 of the buoy 20 by the counterweight 50 may cause the orientation of the buoy 20 to tilt slightly away from the vertical. However, with the aid of the bend stiffener 52 that is fixed to the structure 46 of the buoy 20, this small and temporary change in the angle of the buoy 20 will not have a materially adverse effect upon the capability or the working life of the riser column 16.

The mass of the counterweight 50 and its lateral offset from the central longitudinal axis 42 should be chosen to minimise differences in the moments experienced by the riser column 16 and the buoy 20 between the standby and operational states.

When offloading is complete, the head 34 of the hose 32 is disconnected from the bow loading system 26 of the tanker 10 and is lowered back into the water. The combined weights of the hose 32, the bend restrictor 56 and the clump weight 58 hanging from the head 34 exceed the buoyancy of the buoyancy elements 62, 68. Thus, the head 34 is ballasted to sink back into engagement with the collar 48 of the guide and docking stab 44. The collar 48 guides the second limb 32B of the hose 32 as it slides down through the collar 48. The U-shaped portion of the hose 32 beneath the guide and docking stab 44 lengthens accordingly.

When the offloading system 30 of the invention has been returned to the standby state in this way, the head 34 is held in engagement with the collar 48 by the weight of the hose 32, the bend restrictor 56 and the clump weight 58 that hang from the head 34. That weight load and the resulting moment are transferred to the riser column 16 and the buoy 20 via the structure 46 of the buoy 20 and the bend stiffener 52 that is attached to the structure 46.

The head 34 is thereby held against movement out of the collar 48 due to water dynamics, which in any event may be expected to be minimal at the typical depth of the buoy 20. The U-shaped loop of hose 32 hanging beneath the buoy 20 is even deeper in the water and therefore even less likely to be disturbed significantly by water dynamics that are prevalent nearer the surface 12.

The messenger line 40 remains connected to the head 34 and to the floating line 36 that remains supported by the pair of pick-up buoys 38 at the surface 12, ready to be located and picked up by a tanker 10 again at the start of another offloading operation.

Figure 12:
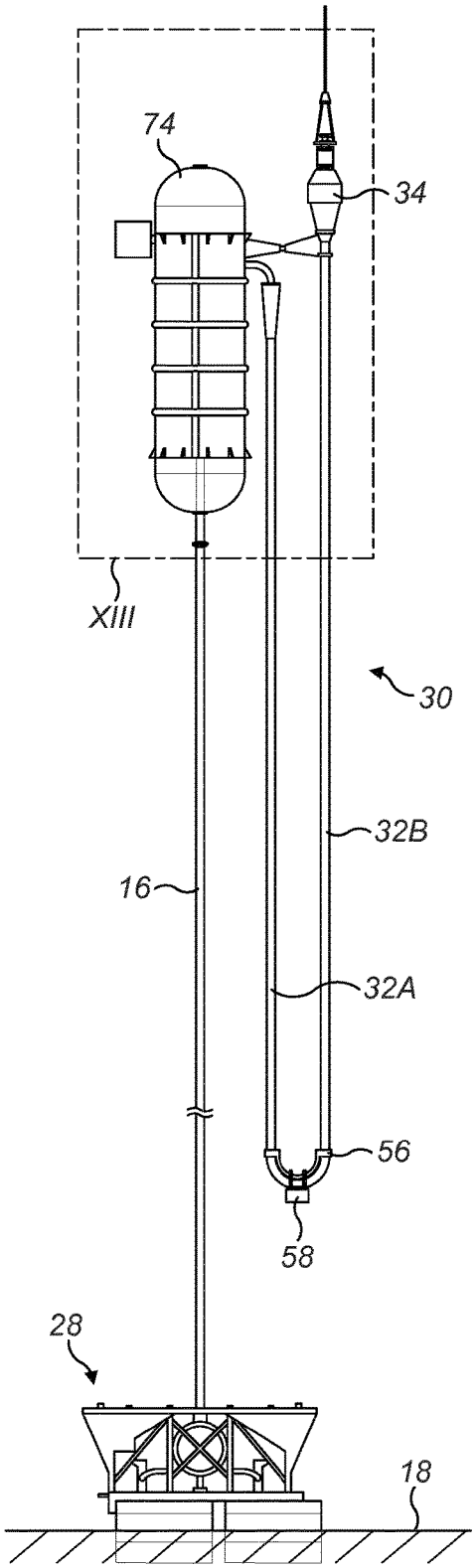
FIG. 12 is a side view of another offloading system of the invention, also in a standby state like the system shown in FIG. 5.
Figure 13:
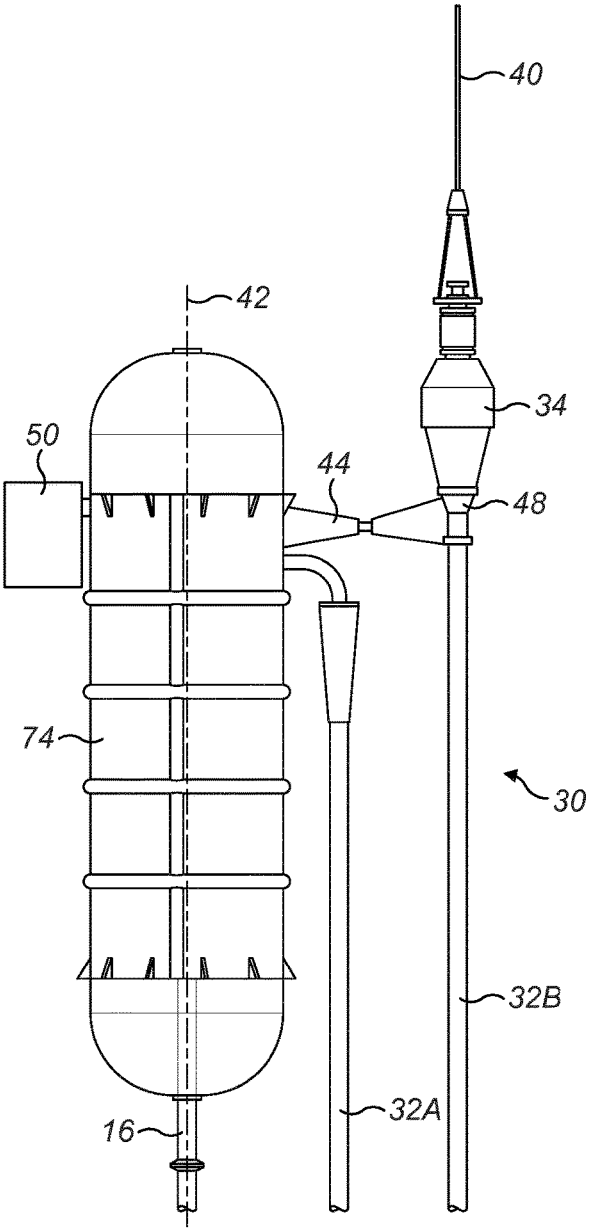
FIG. 13 is an enlarged side view corresponding to Detail XIII of FIG. 12.

Turning finally to FIGS. 12 and 13, these drawings show how the offloading system 30 of the invention may be used with a rigid riser column 16. Again, like numerals are used for like features. Here, the rigid riser column 16 is shown upstanding from a subsea processing and storage installation 28 that serves as a riser base.

A large buoyancy tank 74 provides the increased uplift force that is required to impart the tension necessary to support a rigid riser column 16. Higher tension forces in the rigid riser column 16 do not have any negative effect on the offloading system 30.

It will be noted that, in this example, the guide and docking stab 44 and the counterweight 50 are positioned near the top of the buoyancy tank 74, above its centre of buoyancy. This is in contrast to the stab 44 and the counterweight 50 being near the bottom of the buoy 20 that is used to support the flexible riser column 16 in the previous embodiment. The elevated position of the stab 44 and the counterweight 50 relative to the centre of buoyancy counteracts a tendency for any unbalanced moments to tilt the buoyancy tank 74 relative to the riser column 16.

Many variations are possible within the inventive concept. For example, in principle, it would be possible for a guide and docking stab 44 and a counterweight 50 to be elevated above the bottom of a buoy 20 that is used to support a flexible riser column 16. It may also be possible to delete the counterweight 50 in some embodiments.

In the standby state, the head 34 of the hose 32 may be held in engagement with the collar 48 by inter-engaging formations such as inwardly-facing fingers around the collar, in addition to the effect of the weight of the hose 32, the bend restrictor 56 and the clump weight 58 that hang from the head 34.

The invention claimed is:

1. A subsea riser structure fix offloading hydrocarbons, the structure comprising:

a riser column;

a subsurface buoy that supports the riser column; and an offloading system for conveying hydrocarbons from the riser column to a surface tanker vessel, that system comprising:

a flexible hose hanging from thy riser structure in a U-shape having first and second limbs, an upper end of the first limb communicating fluidly with the riser column and an upper end of the second limb terminating in a pulling head for connecting the hose to the tanker;

at least one clump weight acting on a lowermost bend of the hose between the first and second limbs to maintain tension in the first and second limbs wherein the hose is movable along its length relative to the or each clump weight; and a subsurface holder fixed to the riser structure, the holder being arranged to engage with and support the pulling head so as to hold the pulling head against said tension in the second limb of the hose when the system is in a standby state, the holder being further arranged to guide the second limb of the hose when the pulling head is disengaged from the holder.

2. The riser structure of claim 1, wherein the holder is offset laterally from a central longitudinal axis of the riser column.

3. The riser structure of claim 2, wherein the holder is cantilevered away from a side of the riser structure.

4. The riser structure of claim 2, further comprising at least one counterweight positioned to a side of the central longitudinal axis opposed to the holder.

5. The riser structure of claim 1, wherein the holder slidingly surrounds the second limb of the hose when the pulling head is disengaged from the holder.

6. The riser structure of claim 1, wherein the first and second limbs of the hose lie in a substantially vertical plane.

7. The riser structure of claim 1, wherein the first and second limbs of the hose are substantially parallel to each other.

8. The riser structure of claim 1, wherein the first and second limbs of the hose are substantially parallel to the riser.

9. The riser structure of claim 1, wherein the first and second limbs of the hose are substantially coplanar with the riser.

10. The riser structure of claim 1, wherein the or each clump weight is supported by a cradle that embraces the lowermost bend of the hose, the cradle defining a path along which the hose may move relative to the cradle.

11. The riser structure of claim 1, wherein the or each clump weight is hung from the hose via one or more rollers that lie on the lowermost bend of the hose.

12. The riser structure of claim 1, wherein the clump weight acts on the hose via a bend restrictor that limits the bend radius of the lowermost bend of the hose.

13. The riser structure of claim 12, wherein the bend restrictor has a limiting radius defined by an army of rollers on an upper side of the lowermost bend of the hose.

14. The riser structure of claim 1, wherein the pulling head comprises a downwardly tapering engagement formation that complements a downwardly narrowing engagement formation of the holder.

15. The riser structure of claim 14, wherein the downwardly tapering engagement formation of the pulling head is a bend stiffener that surrounds the hose.

16. The riser structure of claim 1, wherein the pulling head comprises at least one buoyancy element that confers positive buoyancy on the pulling head.

17. The riser structure of claim 16, wherein negative buoyancy of the second limb of the hose and of the or each clump weight acting on the pulling head exceeds the positive buoyancy of the pulling head.

18. The riser structure of claim 1, wherein the subsurface buoy holds the riser upright and under tension.

19. The riser structure of claim 1, wherein the holder is attached to the buoy of the riser structure.

20. The riser structure of claim 1, wherein the holder is disposed at a level above a centre of buoyancy of the buoy.

21. The riser structure of claim 1, wherein the holder is disposed at a level below a centre of buoyancy of the buoy.

22. A method of offloading hydrocarbons to a surface tanker vessel from a buoyantly supported subsea riser structure, the method comprising:

imparting tension in first and second limbs of a flexible hose that hangs from the riser structure in a U-shape, an upper end of the first limb fluidly communicating, with a riser column of the riser structure and an upper end of the second limb terminating in a pulling head for connecting the hose to the tanker;

hanging at least one clump weight from a lowermost bend of the U-shaped hose to impart said tension in said limbs of the hose;

engaging with and supporting the pulling head so as to hold the pulling head against said tension in the second limb of the hose, when the pulling head is subsurface in a standby state;

guiding upwards movement of the second limb of the hose against said tension when the pulling head is being lifted toward the tanker; and moving the hose along its length relative to the or each clump weight.

23. The method of claim 22, comprising holding the pulling head offset laterally from a central longitudinal axis of the riser column.

24. The method of claim 23, comprising applying a counterbalancing moment to the riser structure to a side of the central longitudinal axis opposed to the pulling head.

25. The method of claim 22, comprising limiting a bend radius of the hose at a lowermost bend of the U-shape.

26. The method of claim 22, wherein buoyant upthrust of the pulling head is exceeded by said tension in the second limb of the hose.

27. The method of claim 22, comprising engaging the pulling head with a holder fixed relative to the riser, said engagement being promoted by said tension in the second limb of the hose.

28. The method of claim 22, comprising shortening the first limb of the hose and lengthening the second limb of the hose while lifting the pulling head toward the tanker.

29. The method of claim 22, comprising shortening a U-shape portion of the hose hanging from the riser structure while lifting the pulling head toward the tanker.

30. The method of claim 29, comprising maintaining a U-shaped portion of the hose hanging from the riser structure when the pulling head has been connected to the tanker.

31. The method of claim 30, comprising damping movements of the hose driven by movement of the tanker.

* * * * *